United States Patent [19]

Alford

[11] 4,207,575

[45] Jun. 10, 1980

[54] MEANS FOR REDUCING RE-RADIATION FROM TALL GUYED TOWERS LOCATED IN A STRONG FIELD OF A DIRECTIONAL AM RADIO STATION

[76] Inventor: Andrew Alford, 71 Bacon St., Winchester, Mass. 01890

[21] Appl. No.: 813,763

[22] Filed: Jul. 7, 1977

Related U.S. Application Data

[63] Continuation-in-part of Ser. No. 808,290, Jun. 20, 1977, abandoned.

[51] Int. Cl.[2] ..... H01Q 9/34; H01Q 1/50

[52] U.S. Cl. ..... 343/874; 343/885

[58] Field of Search ..... 343/874, 875, 885; 174/208

[56] References Cited

U.S. PATENT DOCUMENTS

| | | | |
|---|---|---|---|
| 2,184,940 | 12/1939 | Cork et al. | 343/885 |
| 2,298,900 | 10/1942 | Peters | 343/885 |
| 3,365,721 | 1/1968 | Bittner | 343/708 |
| 3,428,923 | 2/1969 | Webb | 343/885 |

FOREIGN PATENT DOCUMENTS

| | | | |
|---|---|---|---|
| 1264541 | 9/1959 | Fed. Rep. of Germany | 343/885 |
| 197492 | 5/1923 | United Kingdom | 343/885 |

*Primary Examiner*—Eli Lieberman

[57] ABSTRACT

A method for decreasing radiation from a guy wire located in a strong electromagnetic field is disclosed. The method comprises placing inductive impedances at regular intervals along a guy wire, each interval being less than a half wavelength long. Each inductive impedance is made greater than $Z_o$ but usually less than 5 $Z_o$ where $Z_o$ is the characteristic impedance of the span between inductances. It is shown that induced current distribution in a span between inductances has, say, a negative current in the central portion of the span and positive currents near the two ends of the span. It is this reversal of the direction of the induced current, together with low magnitude, that results in very low re-radiation. In practice the inductive impedances may be constructed by using coils in shunt with guy insulators. In some applications the inductive impedances may take a different form, for example, inductive sleeves or just coils may be used as inductances.

8 Claims, 7 Drawing Figures

$KS=\theta$ $K=\frac{2\pi}{\lambda}$

MEANS FOR REDUCING RE-RADIATION FROM TALL GUYED TOWERS LOCATED IN A STRONG FIELD OF A DIRECTIONAL AM RADIO STATION

This patent application is a continuation in part of my patent application Ser. No. 808,290, filed June 20, 1977, now abandoned.

This invention relates to means for reducing re-radiation from currents induced in guy wires of tall towers, for example 1000 feet high. Such towers usually have 3 sets of guy wires placed approximately 120° apart in azimuth. Each set may consist of 5 or 6 guys. One or two anchors may be used for all of the guy wires in one set. The diameter of guy wires may vary from 2" down to about 1⅜", most of them being around 1⅝" in diameter. If such a tower is placed in the strong field of a directional AM radio station, which must protect one or several sectors of the azimuth, re-radiation from the guy wires can contribute a substantial portion of the re-radiated signal from the overall tower structure. It has been customary, under such circumstances, to break up the guy wires by insulators made for this purpose. Such an insulator consists of one or two metal yokes with dielectric material used in compression placed between the metal parts connected to the two adjacent guy wire spans. The capacitance of such an insulator assembly made for use in a guy wire 1½ inches in diameter is around 60 pF. For guys having diameters around 2 inches 70 pF capacitance may be expected. A guy wire broken up by insulators placed at equal intervals that are less than ½ wavelength long are usually expected to re-radiate substantially less signal than a guy wire of the same length and orientation without insulators.

The re-radiation pattern of a guy wire set consisting, for example, of six guys in the same vertical plane is directional with one or two major lobes. The re-radiated field, when measured at one mile from a guy wire in the direction of maximum re-radiation, is primarily a function of the span length expressed in wavelengths at the frequency of the including signal and of the insulator capacitance. A set of six guys, in the same vertical plane, for an 1100 foot tower with quarter wave spans between 70 pF insulators typically results in roughly 57 mv/m for every volt/meter of the inducing signal at the guy wire set. If the span length in such a guy wire set is decreased from ¼ of the wavelength to 1/6of the wavelength, the re-radiated field drops to roughly 12.6 mv/v at 1 mile for each volt/meter of the inducing field. The number of insulators required for each guy set depends on the frequency of the inducing signal. When this frequency is near the top of the AM radio band, for example, 1540 KHz, the number of insulators is large, namely, around 40 per guy set with ¼ wavelength spans and 60 per guy set with 1/6 wave length spans. Three such guy wire sets are required for a tall tower. Insulator assemblies capable of withstanding guy wire tensions are very expensive. It is not unlikely that insulator assemblies alone for three guy sets would cost $150 or more if short spans are used.

Even with short spans the residual re-radiated signal may be greater than can be tolerated. It is important, therefore to find a means for decreasing the current induced in each span. One way of accomplishing this result is by effectively decreasing the insulator capacitances by shunting each insulator with a resonant coil. When this is done the re-radiated signal from a guy wire set with ¼ wavelength spans drops from 57 mv/m at 1 mile to about 27 mv/m for each volt/meter of the inducing field.

While investigating the possible use of shunt coils it occurred to me that in practice there was some chance that the coil inductances may be made a little too small for full resonance so that inductive loading would result converting the guy wire into a kind of a low pass filter. A detailed calculation revealed that the pass band extends from zero up to a certain span length which I called the cut-off span length. For spans longer than this cut-off length, but shorter than ½ wavelength, a guy wire with inductive loading behaves like a filter in the cut-off region. The cut-off span length depends on the value of inductive impedance. Investigating further, I found that current induced in a ¼ wave span with inductive loading is substantially lower than the current induced in spans with coil resonated insulators and that furthermore the induced current in the central portion of a span is flowing, say, to the right while the currents near the two ends are flowing to the left. This phenomenon lead me to expect that radiation from a span carrying such currents would be very low. This is indeed the case. I find, for example, that a guy wire set of 40¼ wavelength spans loaded by inductive impedances equal to about 2½ times, the characteristic impedance of the span (roughly 420 ohms) result in only 7 mv/m at 1 mile for each volt/meter of the inducing field. This is roughly 1/9th of the field (57 mv/m) re-radiated by a guy set with ¼ spans separated by 70 pF capacitors at 1 mile per v/m.

For each span length there is a value of inductive impedance which results in the least radiation, for example, with inductive reactances 2.082 times the characteristic impedance for 90° spans, the re-radiated signal at right angles to a span vanishes and only very small minor lobes are radiated. Theoretically the reduction factor in this case is 86. This condition, however, corresponds to the cut-off span length of 87.7° which is very close to the actual span length of 90°. With inductive loading 2.5 times the characteristic impedance still gives an improvement factor of about 9.3 while the cut-off span length under these conditions is about 77.3° which is pretty well below the operating condition. It is obviously a matter of choice just how close one wishes to operate to the cut-off span length. For 120° spans the least re-radiated signal condition results in the cut-off span length of 109.3° which is 10.7° below the 120° span length. A very large reduction of re-radiation is obtained with 120° spans separated by inductive impedances about 14.2 times the characteristic impedance.

One way to achieve inductive loading in practice is by using coils in shunt connection with the guy insulators. The inductive impedance is obtained when the coil has an inductance that is lower than that which results in resonance with the capacity of the insulator. The required coils may be designed by methods well known in the art. The following is an example of a coil, which, when connected in shunt with a 72 pF insulator, results in impedance about 2.5 times the characteristic impedance $Z_o$=424 ohms at 1.54 MHz. The coil is 6 inches in diameter, 12 inches long, is wound with about 29 turns of copper wire about 0.128 inches in diameter. Such a coil could be incapsulated in a fiber glass cylinder filled with dielectric foam to keep out moisture.

One object of my invention is to provide a means for reducing re-radiation from guy wires of a tall tower located in the field of a directional AM radio station.

Another object of my invention is to reduce the required number of insulators and still obtain low re-radiation from the guy wires.

Still another object is to provide a simple and effective means for reducing re-radiation from guy wires of medium or short towers when very low re-radiation levels are required.

Other objects, features and advantages of the present invention will be apparent from the following description of embodiments of the invention which represent the best known use of the invention. These embodiments are shown in the accompanying drawings.

FIGURES

Figure 3:
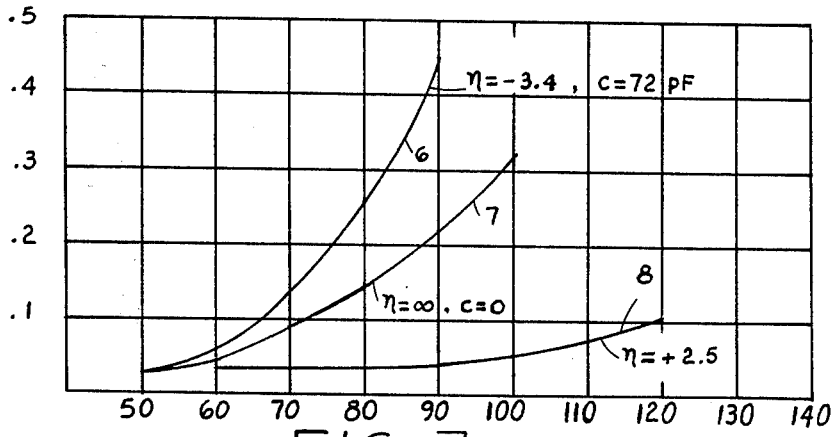

FIG. 3 curve 6, shows values of $v_o$ plotted as a function of span length $\theta=360°$ S/λ for $\eta=-3.4$ corresponding to 72 pF capacitors. Curve 7 corresponds to capacitors resonated by coils ($\zeta\rightarrow\infty$). Curve 8 corresponds to inductances having $\eta=2.5$.

Figure 4:
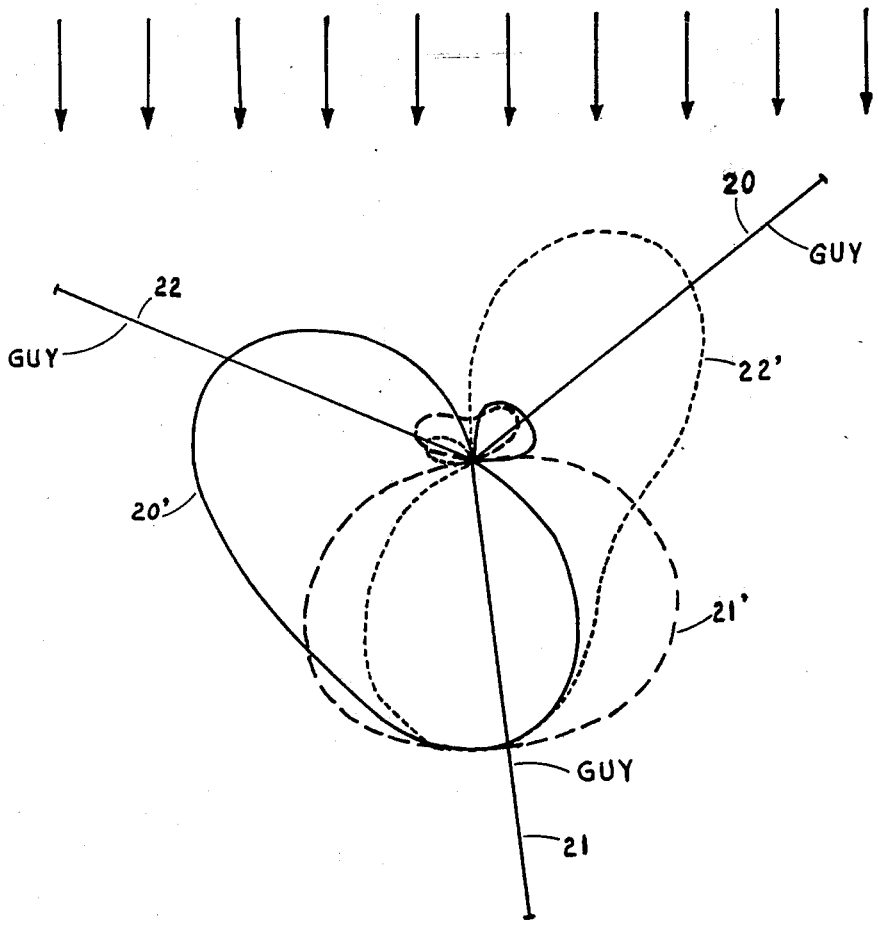

FIG. 4 shows the shapes of the directional patterns re-radiated by an arrangement of three sets of guy wires.

Figure 5:
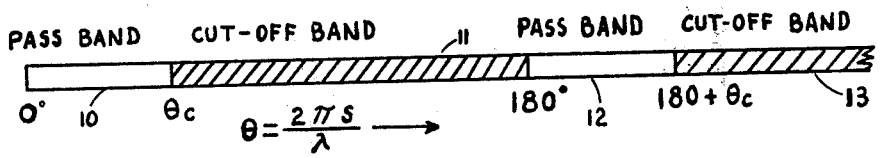

FIG. 5 shows pass bands and cut-off bands of a guy wire loaded with inductances with $\eta=2.5$ plotted vs. span length in electrical degrees.

Figure 6:
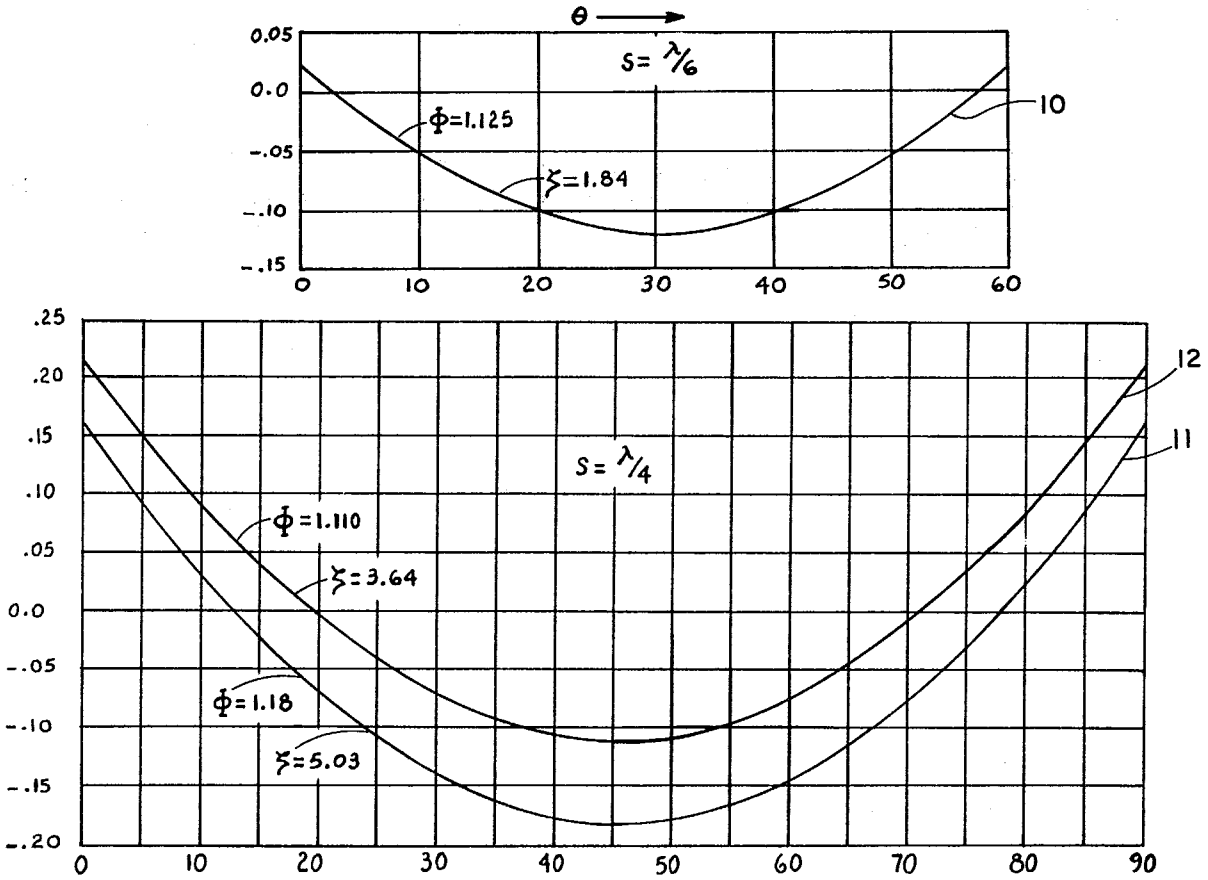
Figure 7:
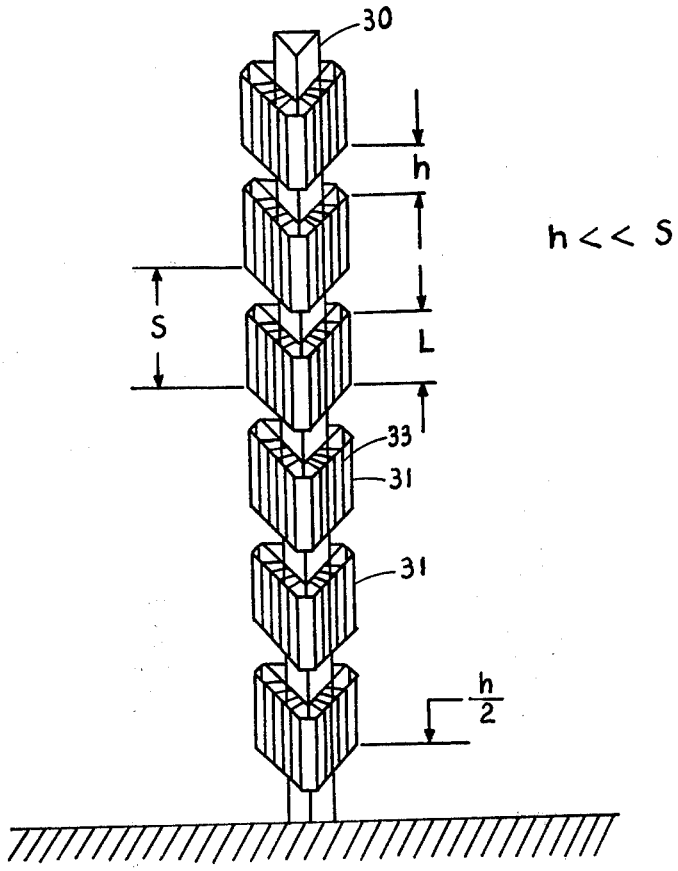

FIG. 6 shows the distributions of currents induced. Curve 10 is for a 60° span for $\Phi=1.125$, $\zeta=1.84$. Curve 11 is for a 90° span with $\Phi=1.18$, $\zeta=5.03$ and Curve 12 is for a 90° span with $\Phi=1.110$ $\zeta=3.64$ FIG. 7 shows a tower with wire sleeves. The length of each sleeve is shortened below one quarter wavelength to obtain the desired value of inductive impedance at the open ends in accordance with the invention.

Figure 1:
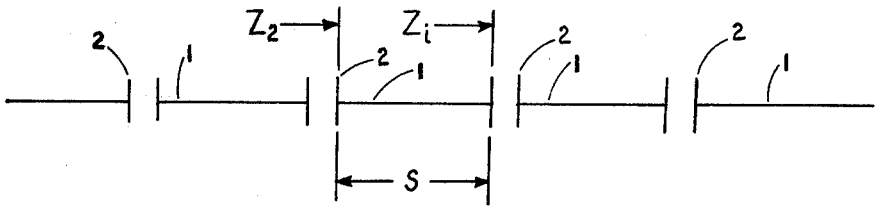
FIG. 1 shows a guy wire broken up by insulators and definitions of impedance $Z_i$, $Z_2$ and span length S.

FIG. 1 shows a diagrammatic view of a portion of a guy wire. In which 1 is a steel cable, 2 is a guy wire insulator which, in electrical terms, is equivalent to a capacitor having capacity C. $Z_i$ is the iterative impedance seen looking into a capacitor at a point next to the capacitor. $Z_2$ is the impedance seen at the other end of the span looking at $Z_i$ through one span of cable of length S. All spans and insulators in a given guy wire are assumed to have equal lengths.

In order to calculate re-radiation of a guy wire broken up into equal spans, it is desirable to first consider the guy wire as a transmission line which is excited by a generator in one of the spans or at one end of the guy wire. To do this it is necessary to find a value of the characteristic impedance $Z_o$ to be used in calculating the transmission through each span. An approximate value of the characteristic impedance $Z_o$ is given by equation 1:

$$Z_o=60\cdot\ln(S/d) \tag{1}$$

where S is the length of the span, d is the diameter of the guy wire and ln is the natural logarithm. It is convenient to express the impedance of one of the capacitors at the frequency of the inducing station in terms of $Z_o$. As usual, the impedance $-jX$ of the capacitor is given by equation 2:

$$jX=-j(1/C\omega) \tag{2}$$

This value is in ohms. It can be expressed in terms of $Z_o$. Accordingly let $$\eta=X/Z_o \tag{3}$$

and $$\rho=\rho_o e^{ju}=\frac{Z_i-Z_o}{Z_i+Z_o} \tag{4}$$

Where $Z_i$ is the iterative impedance seen looking through one of the capacitors into a long guy wire broken up by similar capacitors as shown in FIG. 1 $\rho_o=|\rho|$ and u is the phase of the reflection coefficient Once the value of $\rho$ is determined the iterative impedances can be calculated. Let $\theta$ be the electrical length of a span of length S. Expressed in radians $\theta=2\pi S/\lambda$ where λ is the wavelength at the frequency of the AM Radio station.

$$Z_2=Z_o\frac{1+\rho\, e^{-j2\theta}}{1-\rho\, e^{-j2\theta}} \tag{5}$$

The impedance seen looking at $Z_2$ through the next capacitor of reactance $-jX$ is again equal to the iterative impedance $Z_i$. It follows that $$Z_i=-jx+Z_o\,\frac{1+\rho e^{-j2\theta}}{1-\rho e^{-j2\theta}} \tag{6}$$

It can be shown that equation (6) is equivalent to two equations:

$$(\rho_o^2-1)\cdot\mathrm{Sin}(u-\theta)=0 \tag{7}$$

and $$\rho_o^2-2\rho_o(2/\eta\mathrm{Sin}\theta+\mathrm{Cos}\theta)+1=0 \tag{8}$$

Let $\gamma=2/\eta\mathrm{Sin}\theta+\mathrm{Cos}\theta$. When $\gamma^2>1$ $\rho_o$ is real and waves can propagate along the guy wire. When $\gamma^2>1$, $\rho_o=1$ so that the guy wire behaves as a filter in the cut-off region. The parameters which determine the magnitude of $\gamma$ are (1) the span length $\theta$ between insulators and (2) the value of $\eta=X/Z_o=1/Z_oC_\omega$ where C is the capacitance of an insulator and $\omega=2\pi\times$frequency of the inducing field.

The cut-off region in terms of span length extends from zero to $\theta_c$ which can be determined from the equation $$\tan\theta_c/2=2/\eta \tag{9}$$

Since $\eta$ is negative $\theta_c$ comes out negative. One should therefore add 180 to the negative $\theta_c$ to get the correct value of $\theta_c$.

A guy wire with capacitors should be made with span lengths less than $\theta_c$ long. When this is the case each span may be considered by itself because the power extracted by the span from the inducing field is not passed on to other spans although wattless current does flow between adjacent spans.

Figure 2:
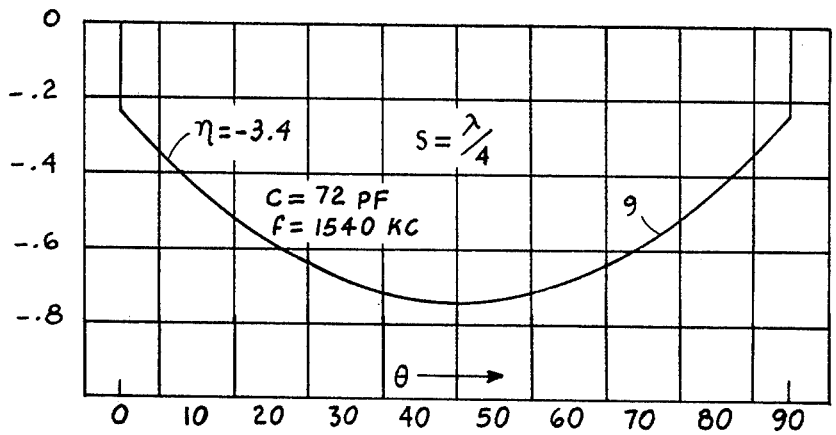
FIG. 2 shows the distribution of the calculated induced current 9 in a span S=one quarter wavelength long (90 electrical degrees), assuming insulator capacity C=72 pF, and in a 60° span also with C=72 pF.

The current induced in an individual span of a guy wire may be calculated by extending the method described by A. Alford in the Proceedings of the IRE, February 1941. I find that the calculated current distribution is given by the following formula:

$$i = \frac{E_o \lambda \cos\psi}{2\pi Z_o} [1 - \Phi \cos (ky)] \quad (10)$$

Where $E_o$ is the inducing field in volts/meter; $\lambda$=wavelength in meters, $\psi$ is the angle between $E_o$ and the span and $$\Phi = \frac{1}{\cos\frac{\theta}{2} + \frac{1}{\xi}\sin\theta/2} \quad (11)$$

where $\zeta = Z_i/Z_o$=the normalized iterative impedance. $\zeta$ is negative when $\eta = X/Z_o$ is negative. FIG. 2 shows the shape of the induced current in a 90° span with 72 pF capacitors.

There is a simple relation between $\zeta = Z_i/Z_o$ and U, namely, $\zeta$=Cot U/2. The value of can be calculated from $$\mathrm{Cos}(U-\theta\theta = \mathrm{Cos}\theta + (2/\eta)\mathrm{Sin}\theta \quad (12)$$

for given values of $\eta$ and $\theta$.

The vertical field re-radiated by a guy wire set as received at distance $r_o$ (meters) is found to be given by the following approximation equation $$|F| = \frac{30E_o\lambda}{\pi r_o} \cdot v_o \cdot S \frac{\sin\xi}{\xi} \quad (13)$$

where $\xi = K(b/2)(\mathrm{Cos}\Delta\alpha_o + \mathrm{Cos}\Delta\alpha)$ b=The horizontal projection of the guy wire set $K = 2\pi/\lambda$ $\Delta\alpha$=Azimuth angle (mathematical) as measured counter clockwise from the inducing AM radio station to the vertical plane containing the guy wire set $\Delta\alpha_o$=the angle measured from the vertical plane of the guy wire set to the point where the re-radiated field is measured $$S = \sum_i Ni \cos\delta_i \quad (14)$$

where $N_1$, $N_2$, $N_i$ is the number of spans in each guy wire is the angle made by the guy wire with the vertical $$V_o = [\Phi \mathrm{Sin}(\theta/2) - \pi(S/\lambda)] \quad (15)$$

S=length of span $KS = \theta$, $K = 2\pi/\lambda$ $$\Phi = \frac{1}{\cos\theta/2 + \frac{1}{\xi}\sin\theta/2} \quad (16)$$

$\zeta = Z_i/Z_o$ ($\zeta$ is negative when X is negative)

Typical values of $V_o$ obtained for C=72 pF are plotted as curve 4 in FIG. 3. The capacity of the capacitors which are suitable for withstanding the tensions in guy wires 1⅜ to 2 inches in diameter are large and are usually greater than 55 pF. One can, however, effectively decrease the capacity to zero by resonating the capacitor with a shunt inductor. Assuming a high Q circuit it is found that then $\zeta \rightarrow \infty$ and the corresponding curve for $V_o$ in FIG. 3 is curve 5.

In a typical guy wire set of 6 guys which is broken up into 90° spans, there is a large number of spans. For example, suppose the frequency of the inducing field is 1540 KHz $\lambda$=639 feet (194.8 meters). The number of spans is around 40. With 60° spans one would have about 60 spans per set of guys. There are three sets. The cost per insulator with hardware is of the order of $1,000.00. It is obvious that a decrease in span length from 90° to 60° results in an increase from 40 spans per set to 60 spans per set which would mean the extra cost of 3×20=60 more insulators.

The re-radiation pattern of a guy wire set is directional. An example of the patterns re-radiated by three guy wire sets is shown in FIG. 4. These patterns were calculated from equation (13). It is the last factor in (13) which is responsible for the directivity. The maxima of the three directional patterns in FIG. 4 are the same. For example: A guy wire set with 39 quarter wave (90°) spans and 72 pF capacitors, in the direction of a maximum radiates 86 mv/m at one mile for each volt/meter of the inducing field.

It is true, of course, that each span re-radiates a small amount but when radiations from 40 or 60 spans add up one gets a large signal. In order to visualize the size of this re-radiation one may compare it with re-radiation from a resonant quarter wave placed in the same field. It is 32 mv/m at one mile per v/m.

There are situations where re-radiation of 30 mv/m at 1 mile per v/m is more than one can tolerate from a set of guy wires. While confronted with this kind of a problem, one may ask the following question: Suppose that in an effort to reduce re-radiation by shunt coils one made the coils too small so that the negative reactances of the capacitors were replaced with positive reactances: Would re-radiation increase or decrease?

When X is positive equation (2) is still valid. In fact, all equations 2 through 16 are still good except that now X, $\eta$, $Z_i$, $\mu$ and $\zeta$ are all positive.

A guy wire loaded with series inductors is, of course, a kind of a low pass filter. For example, for $\eta = X/Z_o = +2.5$ (this means that the parallel circuit would have +j 1060 ohm reactance at 1540 KHz with $Z_o$=424 ohms), the guy wire would then behave as is shown in FIG. 5 in which the pass bands 10,12 and cut-off bands 11,13 are plotted vs span length $\theta$. It is seen that with $\eta$=2.5 one could use spans between 77.3° and 180° provided that re-radiation from them was low.

The first cut-off band starts with $\theta_c$ and ends at 180°. The value of $\theta_c$ is found from equation (9). Since this time $\eta$ is positive $\theta_{c/2}$ is in the first quadrant. From equation (9) it may be seen that $\theta_c$ decreases as $\eta$ increases and vice versa.

For spans longer than $\theta_c$, but shorter than 180°, the guy wire is in a cut-off region. Within this region it may be used provided that the induced currents in the spans are small. In order to determine the mangitude of the induced current and to find its distribution in the span, one may again use equations (10) and (11), but in this case, the value of $\zeta$ is positive. FIG. 6 shows three curves: Curve 11 gives the current distribution in a 90° span of a guy wire with inductive loading having $\zeta$=5.03 which corresponds to $\eta$=5.229. Curve 10 shows the current distribution in a 60° span calculated using $\zeta$=1.84, which for $\theta$=60°, corresponds to $\zeta$=3.473. The corresponding lower limits of the cut-off band are: $\theta_c$=41.90, $\zeta$=5.229 for $\theta$=90°. For $\theta$=60°, $\eta=3.473$ and $\theta_c=59.9°$ Thus the 90° span with $\zeta=5.03$ would be operating well within the cut-off limit. The 60° span would be at the edge of the limit.

By comparing curve 11 in FIG. 6 with the current distribution for 90° spans with capacitors shown in FIG. 2, it can be observed that the inductive loading greatly decreases the current and furthermore that with inductive loading at the ends of the spans reverse currents are observed.

The shunt coil which would be required for $X=5.229\times Z_o=2217$ ohm impedance of the parallel circuit would have an impedance of j873 ohms. At 1540 MHz this would require that the inductance be 90.3 microhenries. The approximate dimensions of the coil could be as follows: diameter=6 inches, length=12 inches, number of turns=51.5. The wire diameter 0.128 inches. This coil could be incapsulated in a fiber glass cylinder filled with dielectric foam to exclude moisture. In comparison with the large sizes of the guy wire insulator assemblies, the dimensions of the coil are quite small and are believed to be practical.

Since the comparison of the current distribution in FIG. 6 with the current distribution in FIG. 2 shows that inductive loading gives lower currents than capacitive loading, it is useful to calculate the re-radiated field of a span and of a guy wire set. This may be done by using equations (13) through (16) with $\zeta$ now having positive values. The value of $V_o$ which one obtains for a 90° span with $\Phi=1.18$ is 0.049 This is to be compared with $V_o=0.68$ for typical capacitors. Other factors in the equation for the field of a guy wire set remain inchanged. Thus the field at one mile would decrease by the factor 0.049/0.68=0.072 so that 86.0/mv/m at 1 mile per v/m would be reduced to 6.2 mv/m at 1 mile for 90° spans. This is a substantial improvement.

The value of $\zeta=Z_i/Z_o=5.03$ in FIG. 6 and for the calculation of the re-radiated field by a span was chosen to illustrate the nature of the induced current distribution and of the magnitude of the re-radiated fields when the span lengths are well above the cut-off length $\theta_c$, which for 90° is 41.9°. One may well ask what value of $\zeta$ for a given span length results in the least re-radiated field. This condition of least re-radiated field is approached when $v_o=0$.

Strictly speaking $v_o=0$ means only that the field radiated at right angles to the span is zero, not that the signal is zero at other angles It is found, however, that when $v_o=0$ the span radiates two minor lobes and their magnitude are very small. Accordingly, let $$V_o=\Phi\sin(\theta/2)-\pi(S/\lambda)=0 \quad (17)$$

For $S=\lambda/4$ ($\theta=90°$) it is found that $\Phi=1.1108$. This condition results in $\zeta=Z_i/Z_o=3.64$, $\eta=3.92$ and $\theta_c=56°$ Table I shows the values of $\mathrm{Sin}\phi_o\cdot V_o$ at various angles. The maximum value is about 0.0052 which corresponds to 0.98 mv/m at 1 mile per v/m. Curve 12 in FIG. 6 shows the calculated current distribution obtained under these conditions. For 120° spans $\Phi=1.209$, $\zeta=2.65$, $\eta=2.45$ and $\theta_c=77.5°$ which is 42.5° below the operating length.

TABLE I

| $\phi o$ | $vo\mathrm{Sin}\phi o$ |
|---|---|
| ±90 | .0000 |
| ±70 | .0014 |
| ±50 | .0044 |
| ±30 | .0052 |
| ±10 | .0023 |

TABLE I-continued

| $\phi o$ | $vo\mathrm{Sin}\phi o$ |
|---|---|
| 0 | .0000 |

Table I shows the minor lobes under conditions of normal incidence. In case of oblique incidence the minor lobes will differ in size with the larger lobe being on the side further away from the source (e.g. AM radio station). These minor lobes increase in size as the span length is increased.

It should be pointed out that the form of the inductive reactance is not important. For example, it may be a coil of wire, a parallel tuned circuit having inductive impedance or a section of a roughly concentric tube with one end connected to the wire and with the other end open. In fact, the latter structure may be used to decrease re-radiation at a high frequency from a metal rod, such as a structural member of a tower. The concentric tube may have longitudinal slots, or, in fact, may consist of a number of parallel wires. Such an inductor may be used to reduce re-radiation from a tower. Such wire sleeves or "skirts", as they are sometimes called, are usually made resonant to obtain the highest impedance when looking into the open end. According to this invention the substantially lower re-radiation can be obtained with inductive sleeves. The values of inductance being selected in accordance with the principles explained in this application.

FIG. 7 shows a tower 30 with sleeves 31 which are made of wire. In this figure the wires such as 33 in each sleeve are connected to the tower at their upper ends and are not connected to the tower at the lower ends. These wires are preferably connected with each other at the open ends. The length L of a sleeve is chosen so as to obtain the deisred operating value of inductive impedance X. In this case $$X=Z_{oo}\tan(2\pi L/\lambda)$$

and $$\eta=Z_{oo}/Z_o\cdot\tan(2\pi L/\lambda)$$

where $Z_{oo}$ is the characteristic impedance of the pseudo-coaxial section of line formed by the tower and the sleeve within the sleeve and $Z_o$ is the weighted average characteristic impedance of outer conductor of the sleeve and a section of tower between sleeves. The value $\eta$ is chosen on the basis of the selected length of span S which, in this case, is the spacing between the successive open ends of the sleeves. Whether adjustable capacitors are used or not used in shunt with the open ends of the sleeves, the sleeves should appear inductive at their open ends. Sleeves may be oriented with their open ends up, or, in some cases, alternately in opposite directions.

I claim:

1. Means for decreasing re-radiation from a conducting cylinder comprising (1) a transmitting antenna separated by some distance from said conducting cylinder, (2) a plurality of inductive impedances which are greater than the minimum value determined by the end of the pass-band of the conducting cylinder with the impedances, but less than 5 times the characteristic impedance of the cylinder sections between the impedances, said impedances being spaced at intervals less than a half wavelength long at the frequency of the electromagnetic field within which the conducting cylinder is located.

2. Means for decreasing re-radiation from a conducting cylinder as in claim 1 wherein the interval between the inductances are substantially equal.

3. Means for decreasing re-radiation from a conducting cylinder as in claim 2 wherein the inductive reactance at the frequency of the inducing field is greater than $2Zo \cot \theta/2$ where Zo is the characteristic impedance and $\theta$ is the electrical length of the cylinder sections between the impedances.

4. Means for decreasing re-radiation from a conducting cyclinder as in claim 1 wherein said conducting cylinder is a guy wire stabelizing a tower.

5. Means for decreasing re-radiation from a guy wire as in claim 4 wherein the inductive impedances comprise strain insulators shunted by inductances.

6. Means as in claim 5 wherein the shunting impedances are in the form of coils.

7. Means as in claim 1 wherein each inductor is a coaxial metal sleeve short circuited to the cylindrical conductor at one end, and open circuited at the other.

8. Means as in claim 7 wherein the metal cylinder is a tall tower and coaxial sleeves comprise a plurality of parallel wires.

* * * * *